US009022813B2

(12) United States Patent
Wilkner

(10) Patent No.: US 9,022,813 B2
(45) Date of Patent: May 5, 2015

(54) CONTACT HOUSING FOR ELECTRICAL CONTACT UNITS, ELECTRICAL PLUG CONNECTOR OR MATING CONNECTOR AS WELL AS AN ASSEMBLED ELECTRICAL CONDUCTOR

(75) Inventor: Andreas Wilkner, Griesheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 18 days.

(21) Appl. No.: 13/876,161

(22) PCT Filed: Sep. 21, 2011

(86) PCT No.: PCT/EP2011/066421

§ 371 (c)(1),
(2), (4) Date: Mar. 26, 2013

(87) PCT Pub. No.: WO2012/041746

PCT Pub. Date: Apr. 5, 2012

(65) Prior Publication Data

US 2013/0203299 A1 Aug. 8, 2013

(30) Foreign Application Priority Data

Sep. 27, 2010 (DE) ..... 10 2010 041 451

(51) Int. Cl.
*H01R 13/502* (2006.01)
*H01R 13/514* (2006.01)
(Continued)

(52) U.S. Cl.
CPC ..... *H01R 13/514* (2013.01); *H01R 13/4361* (2013.01); *H01R 13/501* (2013.01)

(58) Field of Classification Search
CPC .. H01R 13/514; H01R 13/506; H01R 13/516; H01R 9/2408; H05K 5/0021; H05K 7/1478
USPC ..... 439/701, 717
See application file for complete search history.

(56) References Cited

U.S. PATENT DOCUMENTS 5,643,009 A * 7/1997 Dinkel et al. ..... 439/595
5,700,163 A * 12/1997 Okabe ..... 439/701
(Continued)

FOREIGN PATENT DOCUMENTS

DE 29804419 U1 5/1998
EP 1 560 298 A1 8/2005

OTHER PUBLICATIONS

International Preliminary Report on Patentability issued by The International Bureau of WIPO, Geneva, Switzerland, dated Apr. 2, 2013, for related International Application No. PCT/EP2011/066421; 7 pages.
(Continued)

*Primary Examiner* — Briggitte R Hammond
(74) *Attorney, Agent, or Firm* — Faegre Baker Daniels LLP

(57) ABSTRACT

The invention relates to a contact housing (1) for at least two electrical contact means, in particular for an electrical plug connector or mating connector for the automotive sector, with two contact-housing modules (10, 20), with a first electrical contact means being able to be set up in a first contact-housing module (10) and a second electrical contact means in a second contact-housing module (20), the contact-housing modules (10, 20) being provided to be able to be moved towards one another and being able to be fixed to one another, in particular being able to be mutually latched with each other. Further, the invention relates to an electrical plug connector or an electrical mating connector, in particular an electrical female connector, and to an assembled electrical line, the electrical plug connector or the electrical mating connector, or the assembled electrical line having a contact housing (1) according to the invention.

10 Claims, 8 Drawing Sheets

Figure 1:
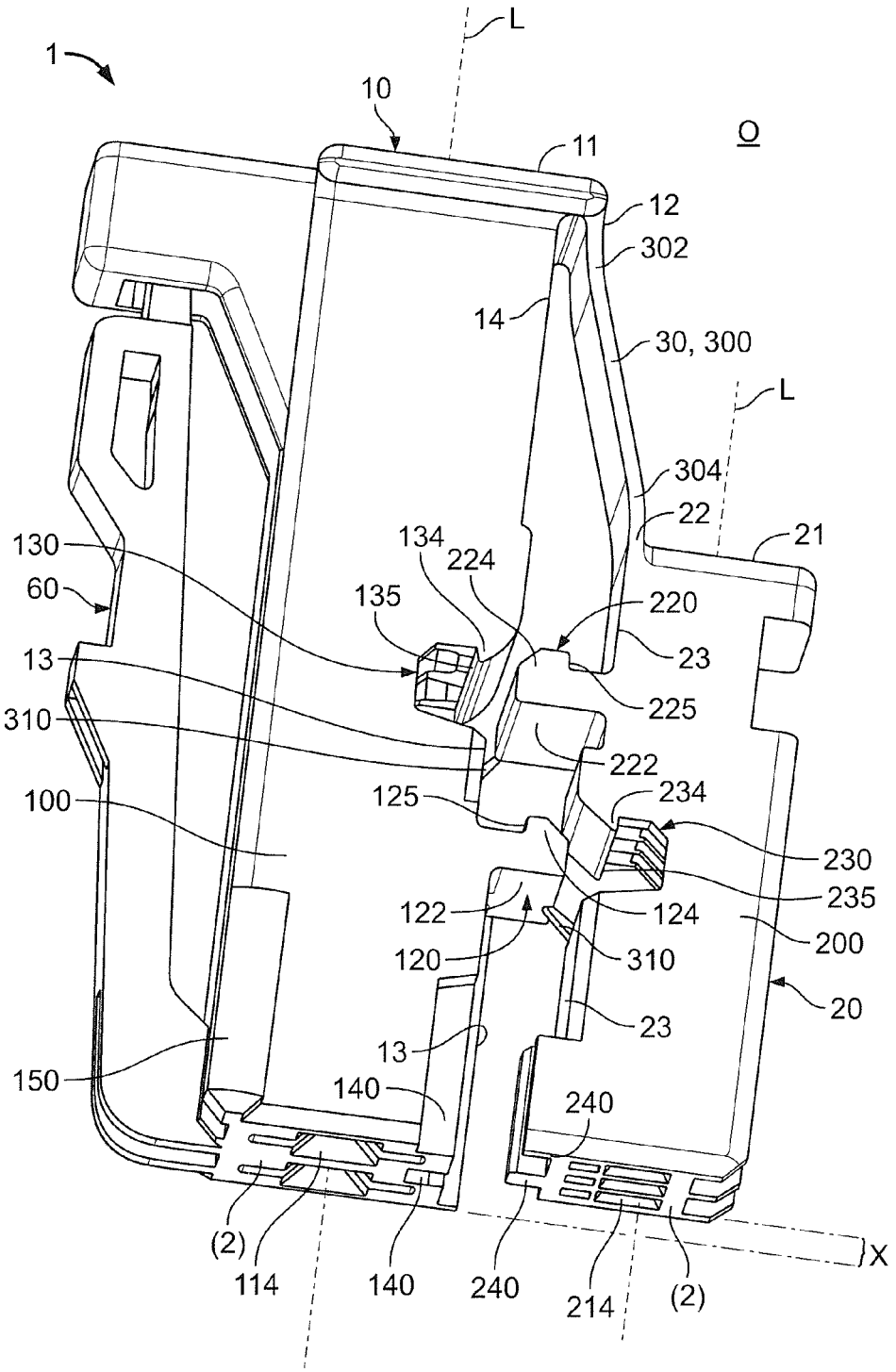

(51) Int. Cl.
*H01R 13/436* (2006.01)
*H01R 13/50* (2006.01)

(56) References Cited

U.S. PATENT DOCUMENTS 5,921,807 A 7/1999 Okabe
5,934,944 A * 8/1999 Aoyama et al. ..... 439/701
6,000,971 A 12/1999 Hatagishi et al.
6,007,386 A 12/1999 Okabe
6,050,859 A 4/2000 Abe
6,056,598 A 5/2000 Ramsey
6,083,056 A * 7/2000 Okabe et al. ..... 439/701
6,354,887 B2 * 3/2002 Maeda ..... 439/701
6,409,551 B1 * 6/2002 Nagai ..... 439/701
6,773,309 B1 8/2004 Shuey
7,297,032 B2 * 11/2007 Kobayashi et al. ..... 439/701
7,309,257 B1 12/2007 Minich
7,637,785 B2 * 12/2009 Irish et al. ..... 439/701
7,695,315 B2 * 4/2010 Hitchcock et al. ..... 439/701
2006/0141871 A1 * 6/2006 Sakamoto ..... 439/701

OTHER PUBLICATIONS

International Search Report and Written Opinion issued by the European Patent Office, dated Nov. 9, 2011, for related International PCT Application No. PCT/EP2011/066421; 12 pages.

* cited by examiner

CONTACT HOUSING FOR ELECTRICAL CONTACT UNITS, ELECTRICAL PLUG CONNECTOR OR MATING CONNECTOR AS WELL AS AN ASSEMBLED ELECTRICAL CONDUCTOR

The invention relates to a contact housing for at least two electrical contact means, in particular for an electrical plug connector or mating connector for the automotive sector. Further, the invention relates to an electrical plug connector or an electrical mating connector, in particular an electrical female connector or pin connector, and an assembled electrical line.

In the field of electronics and electrical engineering, a large number of electrical pin connectors and socket connectors—referred to below as (electrical) plug connectors and also mating connectors—are known which serve to transmit electric voltages, currents and/or signals with a maximum possible range of voltages, currents, frequencies and data rates. In particular in the automotive sector, plug connectors in such case have to permanently ensure perfectly satisfactory transmission of signals and electric power in dirty, damp and/or chemically aggressive environments. Due to a great range of applications for such plug connectors, a large number of specially configured plug connectors are known.

Such electrical plug connectors or mating connectors or their contact housings may be installed on an electrical line or another electrical means, such as a printed circuit board, or on/in a housing of an electrical or electronic device. If a plug connector or mating connector is located on a line or a cable, we usually speak of a plug or a coupling; if it is located on/in an electrical/electronic means, we usually speak of an integrated socket or a (n integrated) bush. Further, a mating connector is often also referred to as a plug receptacle, especially when the mating connector has a supporting collar which is intended to ensure a more robust connection between the plug connector and the mating connector.

Should two different contact systems be used for one electrical plug-in connection, two contact housings are required for a plug side and likewise two contact housings for a corresponding mating-connector side. Such a plug-in connection therefore consists of two individual plug-in connections, the contact housings, e.g. for the plug side of the plug-in connections, having to be produced separately. When an injection-moulding process is used for their production, two casting moulds are required for this. Correspondingly, a further two casting moulds are required for the mating-connector side.

Further, in the case of plug connectors which have a plurality of planes in which the electrical contact means for the plug connector lie, it is awkward to set up a secondary contact lock for the relevant contact means of the respective plane. This applies in particular when the contact locks do not lie in one plane. Furthermore, in the case of many desirable plug-in connections it is difficult to make available contact housings which are simple and quick to fit with components. That is to say that either automatic and inexpensive fitting is dispensed with, or it is necessary to redesign the corresponding interface, i.e. the plug connector and also the mating connector.

It is an object of the invention to devise an improved contact housing for an electrical contact means. Furthermore, it is an object of the invention to devise an improved plug connector or mating connector, and an improved electrical line which can be assembled. The contact housing according to the invention should be able to be fitted with two different electrical contact means, which preferably belong to different contact systems; the contact housing should preferably be able to be produced economically in a single casting process by means of a single casting mould. In such case, the contact means should be arranged in two planes; a contact lock for the different contact means should be simple and quick to set up. Furthermore, the contact housing according to the invention should be able to be fitted with the contact means simply, and therefore the plug connector or mating connector and also the assembled line should be inexpensive to produce.

The object of the invention is achieved by means of a contact housing for at least two electrical contact means, in particular for an electrical plug connector or an electrical mating connector for the automotive sector, according to claim 1; and by means of an electrical plug connector or an electrical mating connector, in particular a female connector, and an assembled electrical line, according to claim 10. Advantageous developments of the invention will become apparent from the dependent claims.

The contact housing according to the invention has at least two contact-housing modules, with a first electrical contact means being able to be set up in a first contact-housing module and a second electrical contact means in a second contact-housing module. A contact-housing module will be referred to below only as "module". According to the invention, these modules are provided to be able to be moved towards one another and can be fixed to one another. In this case it is preferable for the two modules to be able to be latched together. The modules in this case, in an open position of the contact housing, are preferably held at a mutual distance, in particular a constant mutual distance. Further, the modules can be moved towards each other for a closed position of the contact housing, and in so doing can be mutually fastened to each other in at least one spatial direction.

According to the invention, the contact housing for the preferably different contact means, which may in particular belong to different contact systems, such as for example an MCP system (MCP—Multiple Contact Point) and/or an MQS system (MQS—Micro Quadlock system), is divided in one plane. The two parts of the contact housing correspond to the modules which, optionally once a web provided between the modules has been broken or once a corresponding spacer has been removed, can be moved towards one another and are fastened to one another in the closed position. The fitting of the contact housing with the contact means takes place in the open position thereof, i.e. with the modules spaced apart.

In one embodiment of the invention, the modules are, or the contact housing is, provided in one piece, in particular formed in one piece in terms of material. In this case, the modules may be connected together by means of a preferably flexible connecting element, the modules being able to be moved towards one another in a rotary and/or translatory motion. Preferably the connecting element is designed such that it substantially determines a constraint for mutual movability of the modules; i.e. due to the connecting element the one module can be moved towards the other substantially on a given path, the contact housing being transferred from the open position thereof into the closed position thereof.

According to the invention, a two-part but one-piece contact housing is made available which can be fitted with two different electrical contact means, which may in particular belong to different contact systems. In this case, the contact housing or the two coupled modules of the contact housing can be produced in a single casting process in a single casting mould. The contact means in this case are preferably arranged in two planes, a contact lock for the different contact means being simple and quick to set up. For this, merely the corresponding contact means have to be inserted with correct polarisation into the respective contact cavities, which can be done in automated manner or manually.

Following this, the two modules are moved towards each other, it being possible for a second contact lock for the contact elements to be established; see also below on this point. Further, the contact housing is easier to handle compared with two separate contact housings, since the modules are already in a correctly oriented relative position, out of which they merely still have to be moved towards one another. Due to the economical production process for the contact housing according to the invention and the simple fitting thereof, the plug connector or mating connector according to the invention and also the assembled line are inexpensive to produce.

In preferred embodiments of the invention, the connecting element between the modules is a connecting band which is preferably connected via at least one or two integral hinges to the respective module or is fastened thereto therewith. Preferably the connecting band is formed as an integral hinge. In this case, it is preferred for material-formed or integral holding-together of the one module via the first integral hinge to the connecting band and thence via the second integral hinge to the second module to be brought about. In one embodiment, the connecting band extends from an outer side, preferably an outer edge, of the one module to an outer side, preferably an outer edge, of the other module. In another embodiment, the connecting band extends within the contact housing from an outer side, preferably from the lateral surface thereof, of the one module to an outer side, preferably likewise to the lateral surface thereof, of the other module.

In preferred embodiments of the invention, at least one of the modules has a contact-lock means by means of which the first or the second contact means can be locked in a contact cavity of the other module. Preferably, however, both modules have such a contact-lock means, with the first and the second contact means being able to be locked in the relevant contact cavity of the respective other module by means of the respective contact-lock means. In this case, in the closed position of the contact housing the contact-lock means of the respective module projects into the contact cavity of the respective other module. In the case of a contact housing fitted with components, the free longitudinal end sections of the contact-lock means are then seated by means of in each case one securing surface formed thereon in the relevant contact cavity in locking manner on the appropriate contact means.

In preferred embodiments of the invention, the contact-lock means of one module is rib-shaped. A width of this contact-lock means is in particular at least substantially a distance between two outer contact cavities of the other module. This again can preferably be applied to both contact-lock means. Preferably a width of the relevant contact-lock means of the one module corresponds to a width of the other module. In this case, the contact-lock means may have a plurality of individual means for securing the contact means in the other module.

The modules may be fixed to one another by means of the contact-lock means on the one module and a correspondingly formed fastening means on/in the other module. In this case, the contact-lock means is additionally formed as a fastening means which preferably has a latch means, in particular a latch projection. Accordingly, the fastening means of the other module, likewise preferably a latch means, is namely in particular a latch recess. In the closed position of the contact housing, the contact-lock means can preferably be engaged in the fastening means such that the contact-lock means is seated with a latch surface formed thereon on a latch surface of the fastening means.

Preferably both modules in each case have the contact-lock means and, corresponding thereto, in each case the fastening means. In the closed position of the contact housing, then the one contact-lock means of the one module engages in the corresponding fastening means of the other module, and the other contact-lock means of the other module engages in the corresponding fastening means of the one module. This sets up two latching means between the two modules, which means hold the two modules safely and securely against each other in preferably at least two spatial directions.

In preferred embodiments of the invention, the modules have locking means which correspond to each other. In this case, the locking means of the one module may be a locking recess and the locking means of the other module a locking projection. The locking means in the open position of the contact housing may be disengaged or in partial engagement, but are engaged with each other at least in the closed position of the contact housing. Further, the locking means may be formed as a latching means, a clipping means, etc. However, a screwed connection, riveted connection or gluing of the modules may also be used instead of the locking means; in such cases, it is also possible to dispense with a latching function of the relevant contact-lock means.

Preferably the locking means are formed and/or provided such that, in the closed position of the contact housing, the locking means cooperates with the contact-lock means and the corresponding fastening means such that a mutual movement of the modules, except for a certain play of the modules relative to each other, is prevented. This is then also the case with a defective connecting element, so that the contact housing with its modules which are latched mutually to each other can still completely fulfil its function as a contact housing for a plug connector or similar. Also detachment and re-latching of the modules can be applied in such case.

In embodiments of the invention, the modules in the open position of the contact housing are held at a certain distance by means of at least one, but preferably two or more, webs.

For the closed position of the contact housing, the web or webs preferably has or have to be severed. This can be achieved e.g. such that the webs are of such dimensions that, from a certain force onwards which is exerted on the modules from the open position in the direction of the closed position, they automatically break. In this case, care should be taken that the web material remaining does not excessively hinder a closing movement of the modules. The web in question is preferably provided away from the connecting band between the modules or formed integrally therewith.

Figure 2:
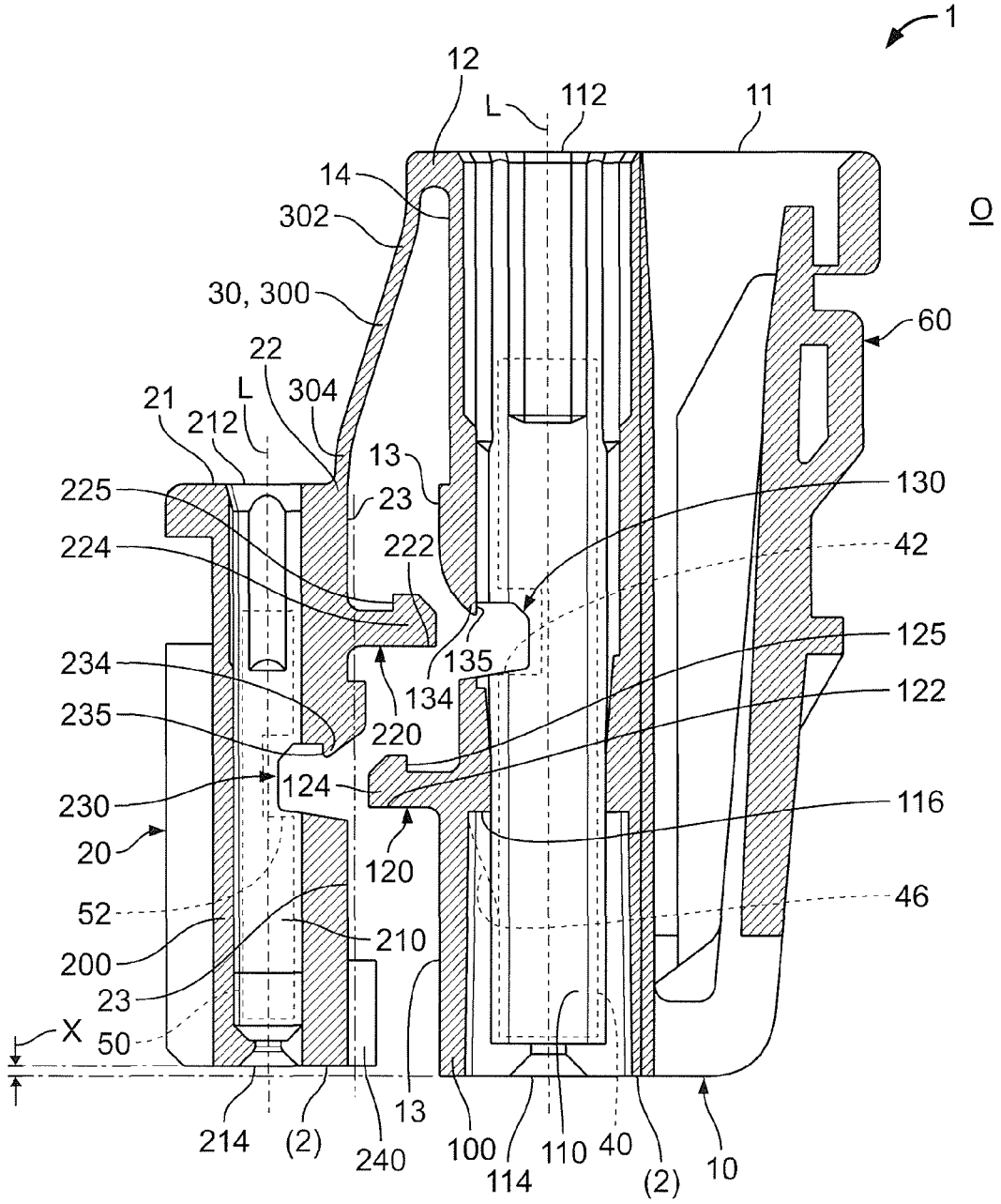
Figure 3:
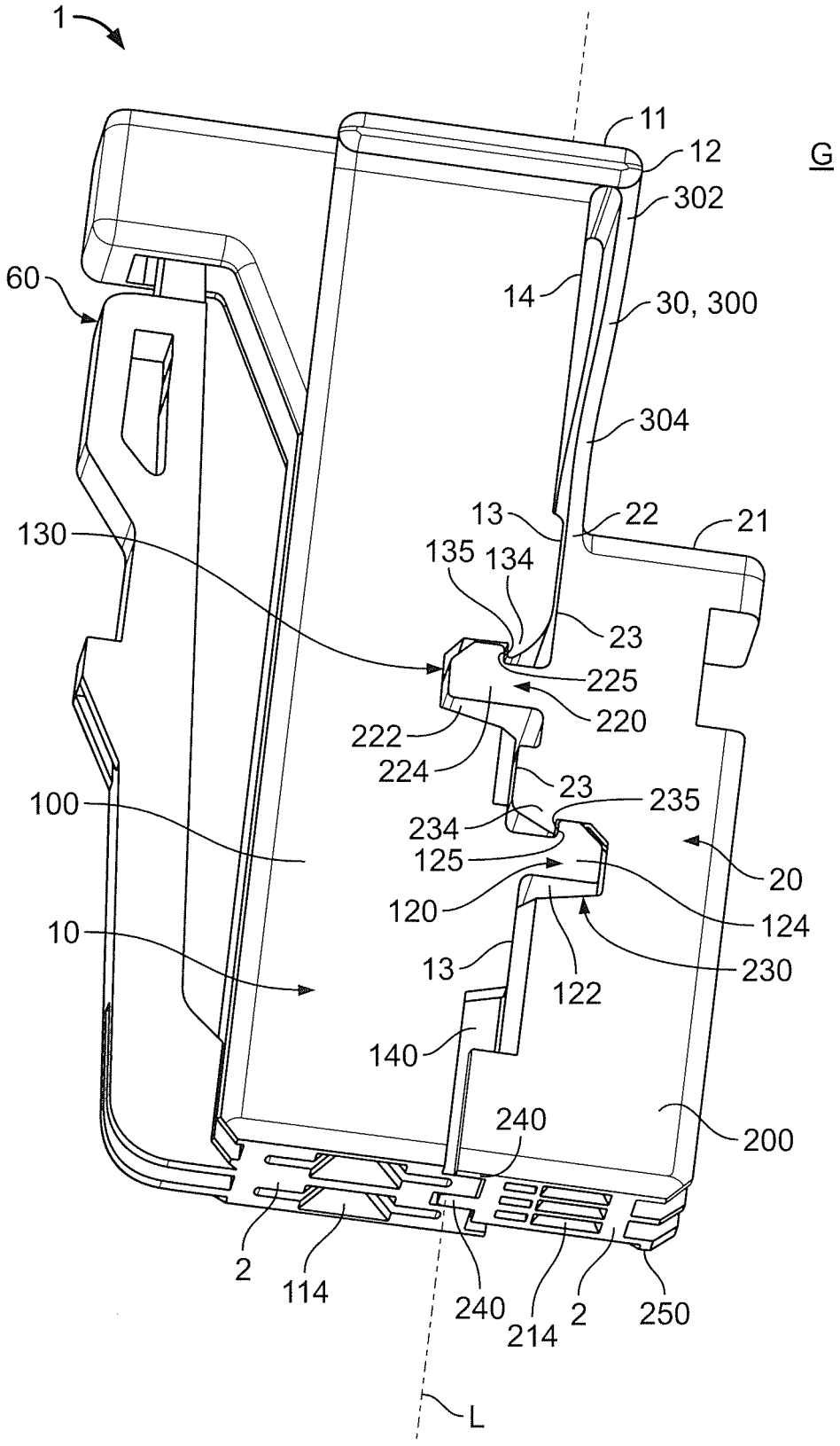
Figure 4:
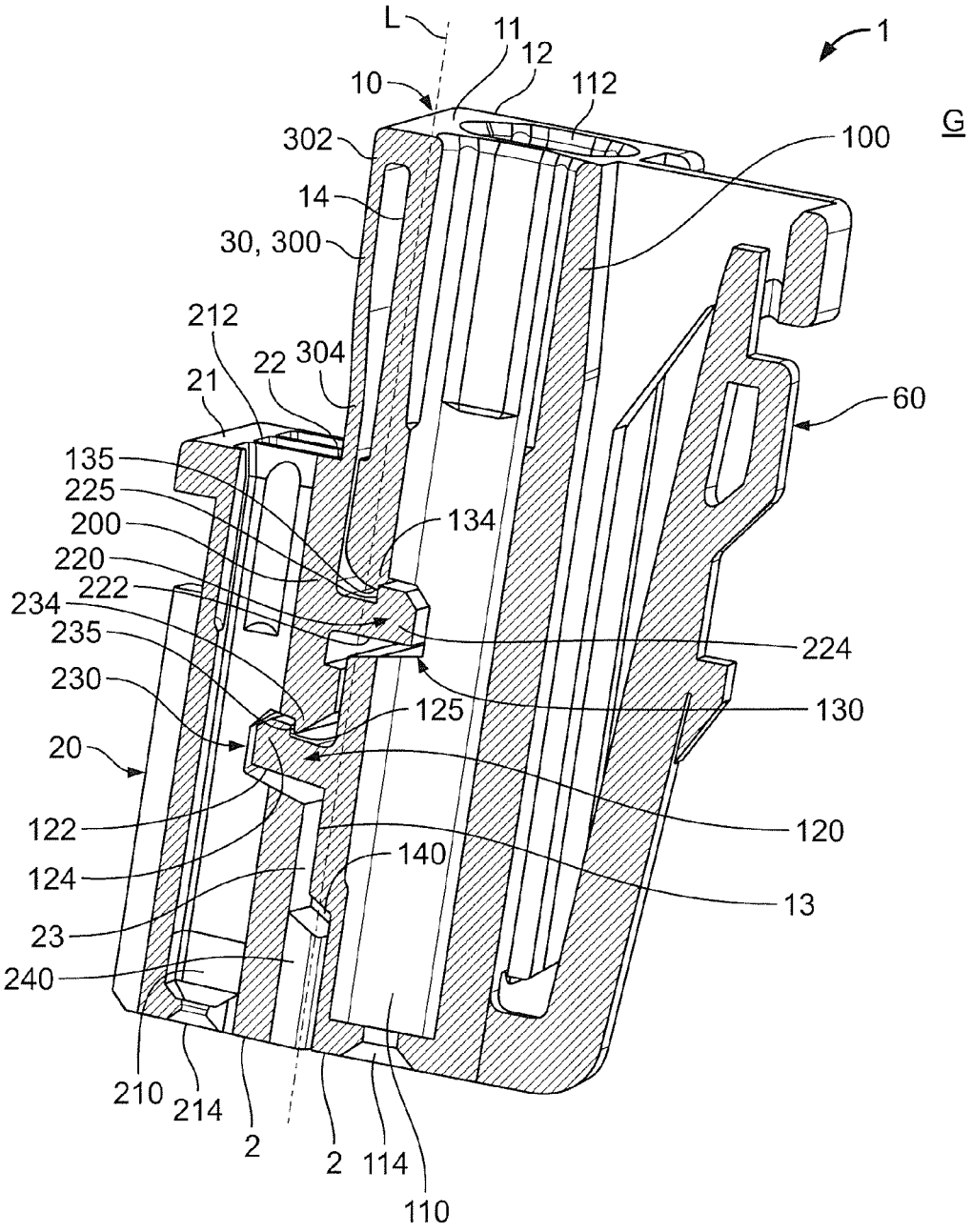
Figure 5:
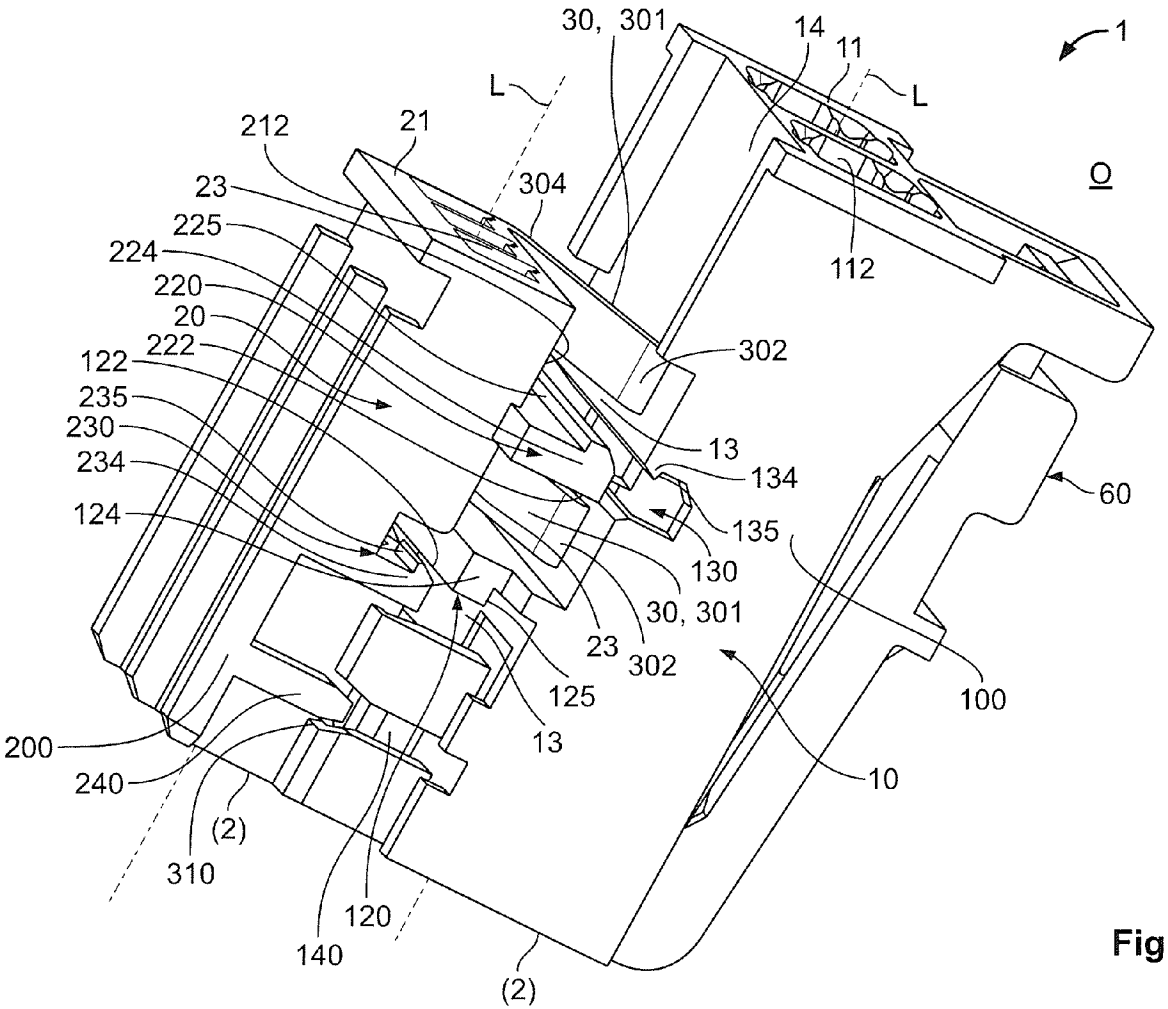
Figure 6:
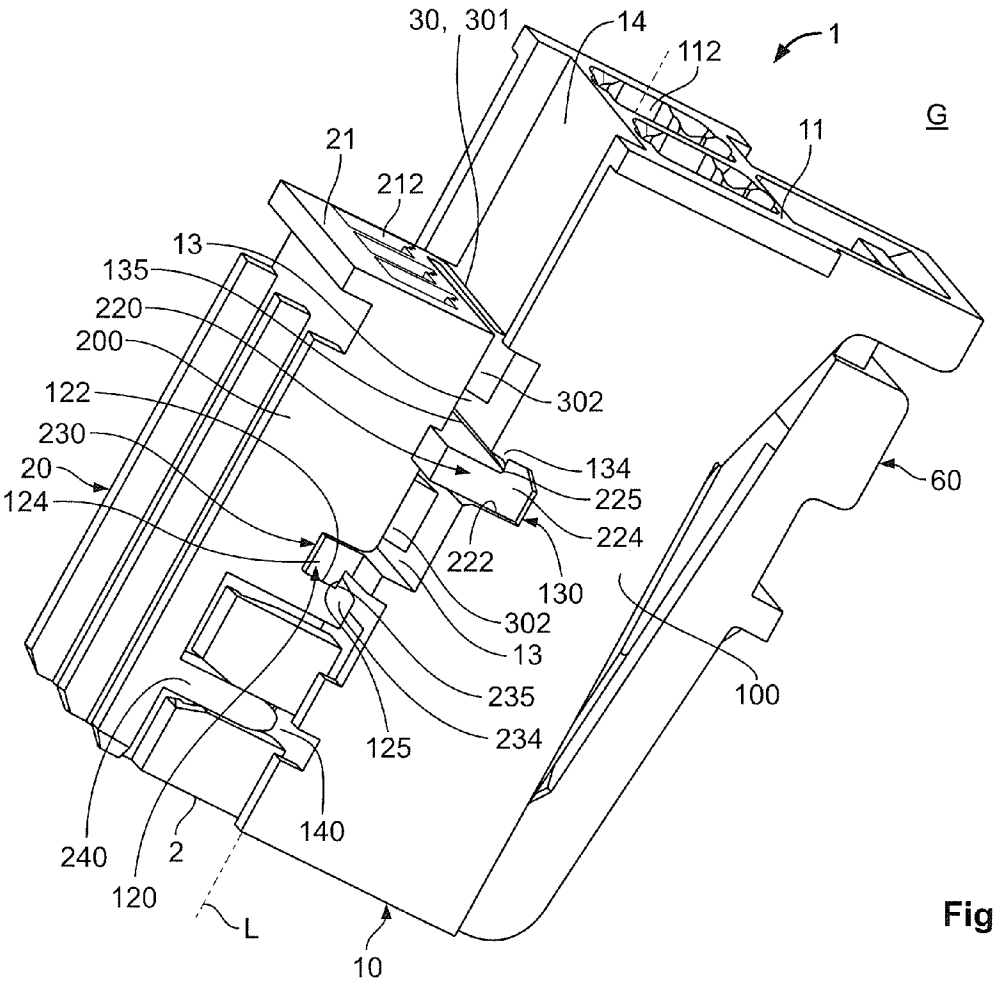
Figure 7:
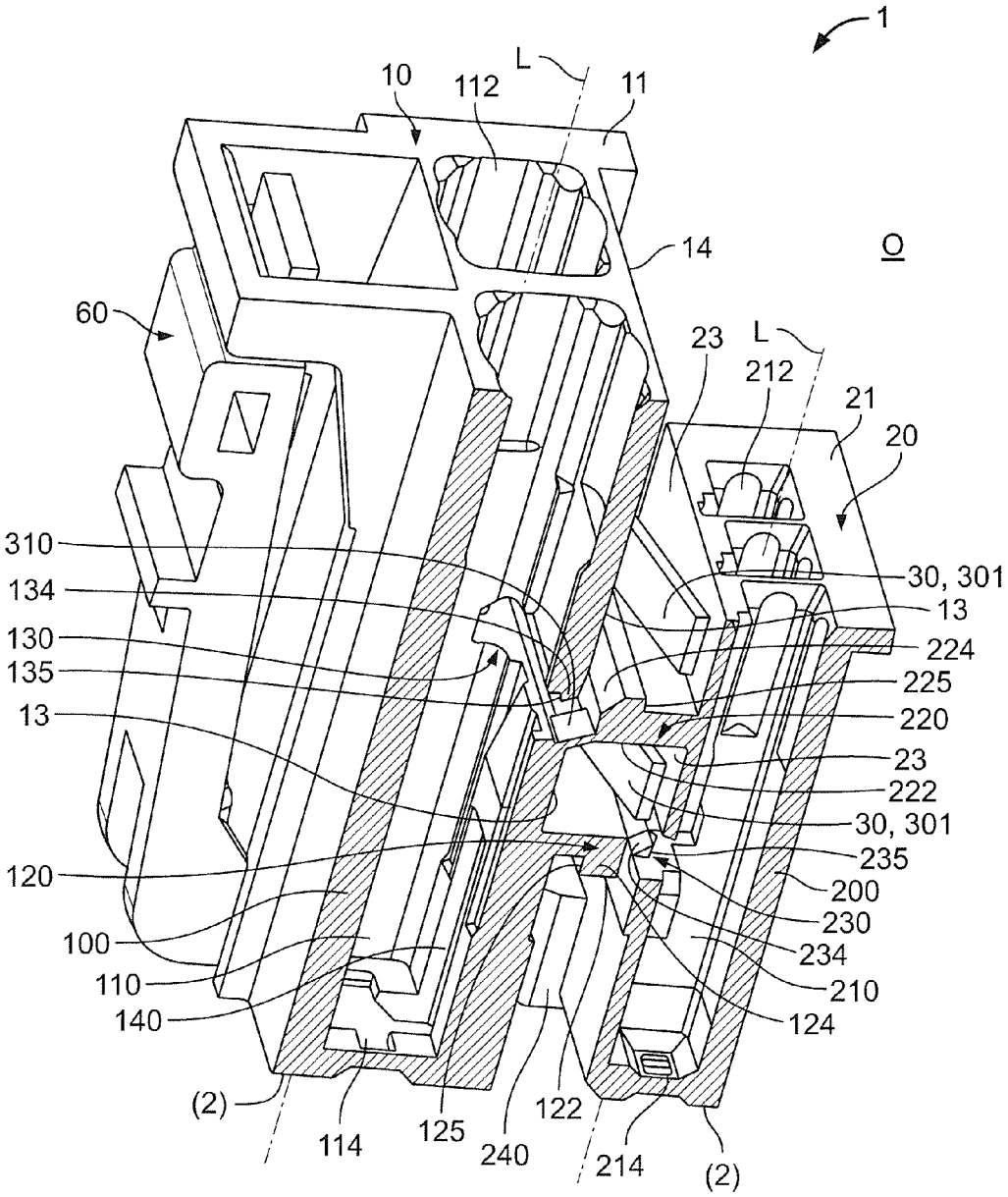
Figure 8:
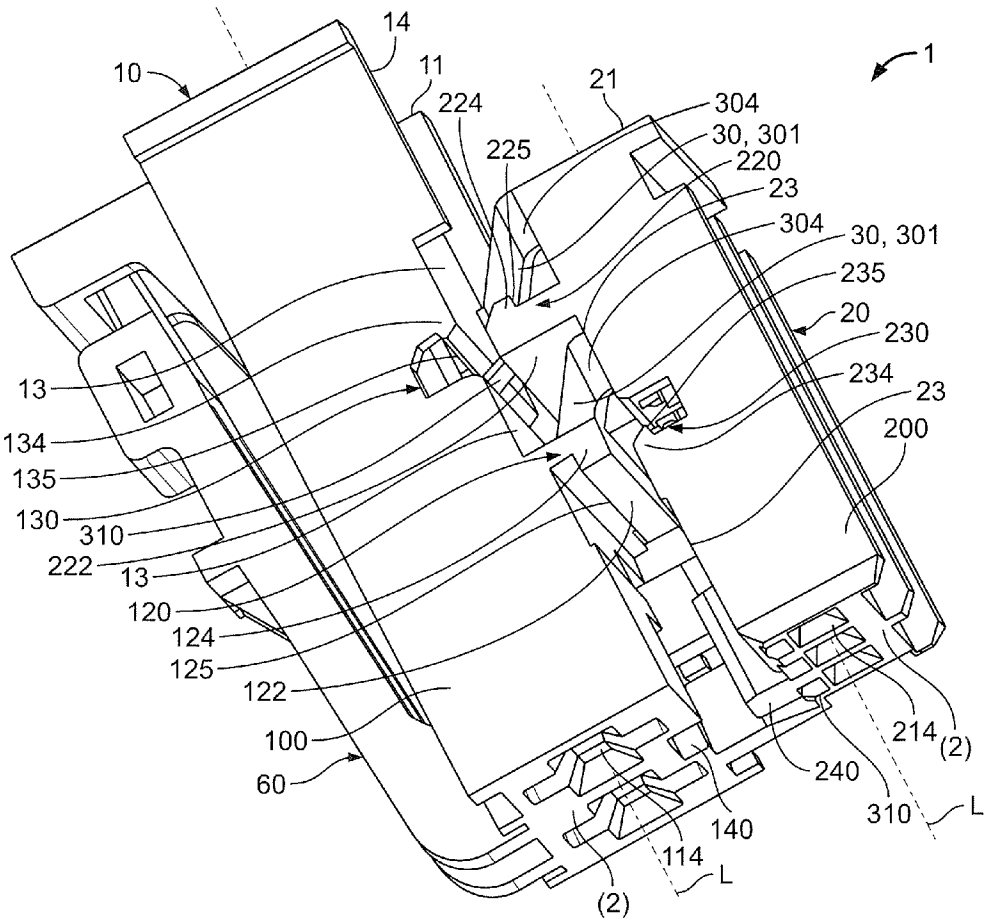

The invention will be explained in greater detail below using examples of embodiment with reference to the appended, detailed drawings. The figures of the drawings depict:

FIG. 1 in a lateral perspective view a first embodiment of a contact housing according to the invention with two contact-housing modules in the open position;

FIG. 2 a three-dimensional sectional view of an embodiment which is somewhat modified compared with the contact housing of FIG. 1, in a region of two contact cavities for different contact systems;

FIG. 3 the contact housing of FIG. 1 again in a lateral perspective view, but in a closed position of the two contact-housing modules;

FIG. 4 a laterally sectioned three-dimensional illustration of the contact housing of FIG. 1 in the closed position thereof;

FIG. 5 in a lateral perspective view a second embodiment of a contact housing according to the invention with two contact-housing modules in the open position;

FIG. 6 the contact housing of FIG. 5 likewise in a lateral perspective view, but in a closed position of the two contact-housing modules;

FIG. 7 a laterally sectioned three-dimensional illustration of the contact housing of FIG. 5 obliquely from above, in the closed position thereof; and FIG. 8 a perspective view of the contact housing of FIG. 5 obliquely from below, in the open position thereof.

The invention will be explained in greater detail below with reference to a plurality of embodiments of (plug-in) contact housings for the automotive sector. The invention is however not restricted to this field, but can be applied to all electrical and electronic contact housings for plug-in connections. This applies in particular e.g. also to contact housings in the computer and (entertainment) electronics field. In the present case, the contact housing is a housing for a plug connector or a mating connector, a plug or a coupling. However, the invention can also be applied to an integrated socket, a (n integrated) bush, a plug receptacle, etc. The electrical contact means which can be fastened in the contact housing are preferably socket contact means and/or pin contact means.

The contact housing according to the invention 1 (see all the figures of the drawings) comprises substantially two units which are separated from each other, the two what are called contact-housing modules 10, 20, which when connected together, in particular fitted together, form the complete contact housing 1 ready for use. Below, the two contact-housing modules 10, 20 are again referred to only as modules 10, 20; further, the electrical contact means 40 (only shown in broken lines in FIG. 2) which can be housed in the first module 10 are preferably referred to as first contact means 40, irrespective of whether they are of the same type (see below) or not (not explained in greater detail). Something similar applies to the electrical contact means 50 (second contact means 50) of the second module 20 (likewise only shown in broken lines in FIG. 2).—The invention in such case is not restricted to two modules 10, 20, but also a plurality of modules of a contact housing 1 can be coupled to one another. Thus it is e.g. possible to provide according to the invention two or more additional modules on the long sides of a module; further, it is for example possible to arrange a plurality of modules one behind another.

Preferably two different forms or types of contact means 40, 50, in particular two different contact systems, are used in the contact housing 1. Preferably these are what is called a Micro Quadlock system (MQS), which has a square contact cross-section in a region of electrical contacting, and a system called Multiple Contact Point (MCP), which usually has a flat electrical contact means, such as a flat-cable plug, with which a corresponding bushing is associated. In this case, it is preferred for the comparatively large module 10 to be able to receive at least one individual first contact means 40, which is preferably formed as an MCP contact means 40, and for the smaller module 20 to be able to receive at least one individual second contact means 50, which is preferably formed as an MQS contact means 50. Other contact systems may of course be used.

The two contact-housing modules 10, 20 are preferably coupled together mechanically by means of a connecting element 30, the connecting element 30 ensuring a certain movability of the one module 10, 20 relative to the other module 20, 10. Preferably the connecting element 30 restricts a mutual displacement ability of the two modules 10, 20 to a translatory and/or rotary motion, in particular a pivoting movement, such that e.g. the relevant outer edges of the modules 10, 20, upon the movement of the two modules 10, 20 towards one another, lie substantially parallel to one another. The connecting element 30 therefore represents a constraint for mutual movability of the two modules 10, 20, and guides the one module 10, 20 on to the other module 20, 10, so that they can be fastened to each other rapidly and simply.

In this case, the contact housing 1 moves out of an open position O, in which the two modules 10, 20 are held at a given distance from each other, into a closed position G, in which the two modules 10, 20 are moved towards one another. The mutual distance of the modules 10, 20 is preferably ensured by means of at least one connecting element formed as a web 310, which is provided between the modules 10, 20. In the open position O of the contact housing 1, i.e. the modules 10, 20 remote from each other, a contact lock for the first 40 and/or second contact means 50 is preferably not yet set up, whereas in the closed position G the contact lock is set up (see below). Further, in the closed position G the modules 10, 20 are fixed, in particular latched, to each other.

In the embodiments illustrated in the drawings, mutual fastening of the modules 10, 20 takes place by means of a latching means, which furthermore also brings about a respective contact lock for the first 40 or the second contact means 50 in the relevant modules 10, 20. This contact lock in this case is preferably a secondary locking. A primary locking of the respective contact means 40, 50 preferably takes place by means of a locking tab provided in each case thereon (see the locking tab 46 indicated of the first contact means 40 in FIG. 2), which can act on a respective latch means (see latch shoulder 116 in FIG. 2) on/in a relevant contact cavity 110, 210 for an individual first or second contact means 40, 50. It is of course possible to set up mutual fastening of the two modules 10, 20 independently of or in addition to the respective contact lock (not shown in the drawings). Further, another contact lock, optionally with a latching function (likewise not shown in the drawings), can be used e.g. in addition to the contact lock illustrated or another latching means.

According to the invention, each module 10, 20 or the module housing 100, 200 thereof has a contact-lock means 120, 220 for the secondary locking of the second or the first contact means 50, 40 respectively of the respective other module 20, 10. Further, each module 10, 20 or module housing 100, 200 has a fastening means 130, 230 which is formed corresponding to the relevant contact-lock means 220, 120. Below, only one subject and one function of the contact-lock means 220 of the second module 20 will be explained in greater detail in cooperation with the fastening means 130 of the first module 10.

The subject and the function of the contact-lock means 120 of the first module 10 in cooperation with the fastening means 230 of the second module 20 takes place analogously, said means being formed at a different position in the contact housing 1 between the modules 10, 20. Preferably these are arranged displaced parallel in a longitudinal direction L of the contact housing 1 relative to the above. The corresponding reference numerals and the representational designations thereof are given once in brackets after the corresponding designations of the representational configuration of the contact-lock means 220 or of the fastening means 130.

FIGS. 1 to 4 show the first embodiment of the invention, the first module 10 having, on an outer side 13 located internally in the contact housing 1, preferably on a long side 13, the fastening means 130 (fastening means 230), located opposite the second module 20. Located opposite this on an outer side 23 located internally in the contact housing 1, likewise preferably a long side 13, of the second module 20, said module has the contact-lock means 220 (contact-lock means 120).

In this case, the second module 20 is arranged somewhat higher by the amount x than the first module 10 with reference to FIG. 2. This is preferable, since the second module 20 relative to the first module 10 upon the movement towards each other executes a circular movement with a comparatively large radius and thus the second module 20 is offset downwards relative to the first module 10 with reference to FIG. 2. In this case, then a connection face 2 of the contact housing 1, apart from a coding 150, 250 and introduction openings 114, 214 for electrical contact means of a mating connector, has a substantially planar form. If desired or necessary, the connection face may also be realised with a step.

The contact-lock means 220 of the second module 20 is preferably provided as a rectilinear rib-shaped projection on the inner outer side 23 thereof and extends preferably substantially parallel to the connection face 2 of the second module 20. A non-rectilinear and/or angled course is of course possible. In this case, the projection is formed as a rib-shaped latch hook 224 (latch hook 124); i.e. the rib extending transversely along the outer side 23 of the second module 20 has the form of a hook in cross-section. The fastening means 130 of the first module 10 has a form corresponding to the latch hook 224; i.e. the cross-sections, at least in a peripheral section, are formed substantially in positive manner relative to one another. The fastening means 130 in this case is formed as a latch means 130, preferably as a latch recess 130.

In the closed position G (FIGS. 3 and 4), the latch hook 224 which extends transversely in elongate manner engages in the elongate latch recess 130, a latch surface 225 (latch surface 125) of the latch hook 224 lying against a latch surface 135 (latch surface 235) of the latch recess 130. The latch surface 135 of the latch recess 130 in this case is preferably provided on a latch hook 134 (latch hook 234) which in the cross-section of the latch recess 130 protrudes inwards thereinto.—The latch recess 130 extends so far into the first module 10 that that said recess merges into one, a plurality of, or all the contact cavities 110 of the first module 10; i.e. in each case is in a fluid connection therewith. In the longitudinal direction L of the contact cavities 110, the latch recess 130 is provided at a level at which a latch means 42, preferably a latch shoulder 42, of the contact means 40 can also be arranged (something similar applies to the contact means 50 in the second module).

In the closed position G of the contact housing 1, the contact-lock means 220 projects so far into the fastening means 130 or into the contact cavity 110 that when mutual latching is set up a securing surface 222 (securing surface 122) of the contact-lock means 220 or the contact-lock means 220 locks the contact means 40 in the contact cavity 110. Preferably in this case, the securing surface 222 lies against the latch shoulder 42 of the contact means 40 (not shown in the drawings). In this case, the contact-lock means 220 extends along and optionally beyond the second module 20 (cf. FIGS. 5 and 6) such that the desired number of contact means 40 can be secured. A preferred length of the contact-lock means 220 in this case corresponds to approximately an appropriate width of the module 10 located opposite.

In the first embodiment of the invention, the two modules 10, 20 are connected by means of a connecting element 300 formed as a connecting band 300, which element is arranged substantially in the longitudinal direction L between the two modules 10, 20. The respective module 10, 20, which is preferably in one piece in terms of material, is in each case in one piece with the connecting band 300 which is preferably formed in one piece in terms of material, e.g. by means of a plug-in connection, but in particular formed in one piece in terms of material therewith; i.e. the contact housing 1 is formed in one piece in terms of material or integrally. In this case, the connecting band 300 may be connected via an integral hinge 302 to the first module 10 and via an integral hinge 304 to the second module 20. Preferably the integral hinge 302 is attached to an outer outer side 11, 14, preferably an outer edge 12 between an end face 11 and a long side 14, and the integral hinge 304 in this case is attached to an adjoining, comparable outer edge 22 of the second module 20.

In order that the modules 10, 20 do not unintentionally move relative to each other and for fitting are at a given distance from each other and are not damaged upon transporting or robust handling, the at least one web 312 is formed between the two modules 10, 20. In the present case, in particular two webs 312 are used, which are provided between the respective contact-lock means 120, 220 and an edge of the respective fastening means 130, 230, and break upon movement of the two modules 10, 20 towards each other.—Further, the contact housing 1 preferably has one or a plurality of codings 150, 250, e.g. formed as lateral projections 150, 250. The codings 150, 250 may be provided on the first module 10 (see FIG. 1) and/or on the second module 20 and extend preferably from the connection face 2 somewhat away in the longitudinal direction L along the respective module 10, 20.

Furthermore, each module 10, 20 has a locking means 140 or 240 respectively which in the closed position G of the contact housing 1 prevent a mutual sideways movement of the two modules 10, 20. That is to say that the locking means 140, 240, at least in the closed position G, prevent a movement of the first module 10 relative to the second module 20, or vice versa, into a direction in which the respective module 10, 20, despite set-up mutual latching by means of the contact-lock means 120, 220 and the fastening means 130, 230, can move. In this case, the locking means 140 is preferably a locking recess 140 and the locking means 240 preferably a locking projection 240, which extend in particular at least partially in the longitudinal direction L of the contact housing 1. This may of course also be realised the other way round. At least in the closed position G of the contact housing 1, the locking projection 240 then engages in the locking recess 140.

In the present embodiments of the contact housing according to the invention 1, the first module 10 has two contact cavities 110 and the second module 20 three contact cavities 210, the longitudinal axes L of the contact cavities 110, 120 spanning a plane in each case which are arranged parallel to each other.—FIG. 2 further shows, leaving aside the different codings 150, 250 of the two modules 10, 20 in FIGS. 1 and 3, a modification of the contact housing according to the invention 1 relative to the other figures of the drawings. The embodiment of FIG. 2 has no spacer formed as a web 310. Further, FIG. 2 shows at least two contact cavities 110, 210 with their longitudinal axes L lying in one plane, this plane being perpendicular to the planes spanned by the contact cavities 110, 210 of the respective modules 10, 20. In the other embodiments, the comparable planes are arranged offset.

In the second embodiment of the invention, only the differences from the first embodiment will be discussed, i.e. the features described in relation to the first embodiment can be transferred analogously to the second embodiment. This relates in particular to the contact-lock means 120, 220 and the fastening means 130, 230.—Just as in the first embodiment, the two modules 10, 20 are arranged to be pivotable relative to each other. If a pivot axis of the first embodiment then lies perpendicular to the longitudinal axis L of the contact housing 1, said axis in the second embodiment lies parallel to the longitudinal axis. The respective pivoting range may in this case be comparatively small; thus only 15° to 30° is sufficient to ensure the function according to the invention of the contact housing 1 or the mutual latching with contact lock. Other angular degrees can of course be used.

In the second embodiment of the invention, the two modules 10, 20 are connected by means of at least one connecting element 300 formed as a connecting band 301, which element is arranged substantially transversely to the longitudinal direction L between the two modules 10, 20. Preferably, however, two connecting bands 301 are provided which extend from the inner outer side 13 of the first module 10 to the inner outer side 23 of the second module 20. In this case, the relevant connecting band 301 preferably extends from a centre region of a lateral surface of the inner outer side 13 of the first module 10 to an edge region of the inner outer side 23 of the second module 20. This therefore stems, because of which the first module 10 is wider than the second module 20. The connecting bands 301 in this case are again integrally connected to the relevant inner outer side 13, 23 preferably by means of integral hinges 320, 304. A lateral offset between the two modules 10, 20 is provided analogously to the vertical offset x of the first embodiment (not shown in the drawings).

The two, preferably parallel, connecting bands 310 in this case are attached to a longitudinal end section of the second module 20, the longitudinal end of which has the fitting openings 212 for the second contact means 50. In this case, a connecting band 301 in the closed position G of the contact housing 1 preferably extends with its narrow long side as far as the end face 21 of the second module 20. In the longitudinal direction L further below (with reference to FIGS. 5 to 8), the fastening means 130 adjoins the first module 10 and the contact-lock means 220 adjoins the second module 20. Thereunder there is then the second connecting band 301, which is then adjoined downwards by the contact-lock means 120 on the first module 10 and the fastening means 130 on the second module 20. Further down in the longitudinal direction L there are provided the locking means 140, 240 of the contact housing 1.

In the second embodiment of the invention, preferably two locking means 140 and two locking means 240 are provided. Locking in each case by means of two locking means 140, 240 takes place in different directions, preferably directions which are perpendicular to each other. Initially, analogously to the first embodiment, two locking means 140, 240 are provided, corresponding to each other, preferably centrally between the two modules 10, 20. Further, a locking means 240, which is preferably formed as a projection, is located laterally on the second module 20. On the first module 10 there is, corresponding thereto, a locking means 240, which is preferably formed as a recess which is formed by two tabs projecting from the inner outer side 13 of the first module 10. This can also be used in the first embodiment of the invention.

The introduction slopes for the contact-lock means 120, 220 may be provided either on the relevant contact-lock means 120, 220 and/or the associated fastening means 130, 230. In the present case, the upper (with reference to the drawing) contact-lock means 220 and the lower fastening means 230 have these introduction slopes, i.e. the introduction slopes are both provided on the second module 20, which is preferably moved towards the first module 10 upon moving the contact housings 1 together. Once the contact housing 1 has been fitted with components, preferably the first module 1 is secured and the second module 20 is moved towards it. This can also be used in the first embodiment of the invention.

Further, in both embodiments of the invention there is the possibility of using a connecting web (not shown in the drawings) instead of the respective connecting band 300, 301, which web optionally breaks upon moving the two modules 10, 20 together, optionally at a predetermined breaking point. Further, additionally or instead of this, one or two lateral integral hinges may be formed between the two modules 10, 20; this can also be applied to the two embodiments of the invention explained at the beginning. In this case, the relevant integral hinge extends laterally from one module 10 to the other module 20, the integral hinge preferably being arranged parallel to the longitudinal axis of the contact housing 1 or of the modules 10, 20 and bridging the gap between the two modules 10, 20. In this case, it is preferred for the integral hinge to be attached to the respective module 10, 20 in the vicinity of the gap.

The invention claimed is:

1. A contact housing for at least two electrical contact means, comprising:

two contact-housing modules, with a first electrical contact means being able to be set up in a first contact-housing module and a second electrical contact means in a second contact-housing module, the contact-housing modules being provided to be able to be moved towards one another and being able to be fixed on one another, being able to be mutually latched with each other; wherein each of the contact-housing modules having a contact-lock means by means of which the first or the second electrical contact means can be locked in a contact cavity in the other contact-housing module, and the first and the second electrical contact means being able to be locked in a relevant contact cavity of the respective contact-housing module by means of the respective contact-lock means;

the contact lock means extending across a width of the corresponding housing at different longitudinal positions thereof in order to lock the first and second electrical contact means at different positions along their length.

2. A contact housing according to claim 1, wherein the contact-housing modules in an open position (O) of the contact housing being held at a mutual distance, and the contact-housing modules being able to be moved towards one another for a closed position (G) of the contact housing, and in so doing being able to be fastened to each other in at least one spatial direction.

3. A contact housing according to claim 1, wherein the contact-housing modules being provided in one piece, and being attached to each other by means of a connecting element, the connecting element preferably substantially determining a constraint for mutual movability of the contact-housing modules, the contact-housing modules being able to be moved towards each other in rotary or translatory manner, or one thereof being able to be moved towards the other contact-housing module substantially on a given path.

4. A contact housing according to claim 1, wherein a connecting band being provided as a connecting element between the contact-housing modules, which band is preferably connected via at least one integral hinge to the respective contact-housing module or is fastened thereto, the connecting band extending from an outer side, preferably an outer edge, of the one contact-housing module to an outer side, preferably an outer edge, of the other contact-housing module, or the connecting band extending within the contact housing from an outer side, preferably from the lateral surface thereof, of the one contact-housing module to an outer side, preferably to the lateral surface thereof, of the other contact-housing module.

5. An electrical mating connector having a contact housing which is formed according to claim 1.

6. A contact housing according to claim 1, wherein at least one of the contact-housing modules having a contact-lock means by means of which the first or the second electrical contact means can be locked in a contact cavity in the other contact-housing module, preferably both contact-housing modules having such a contact-lock means, and the first and the second electrical contact means being able to be locked in the relevant contact cavity of the respective contact-housing module by means of the respective contact-lock means.

7. A contact housing according to claim 6, wherein the contact-lock means of the one contact-housing module being rib-shaped, and a width of the contact-lock means being at least substantially one distance between two outer contact cavities of the other contact-housing module, and preferably a width of the contact-lock means of the one contact-housing module corresponding to a width of the other contact-housing module, the contact-lock means possibly having a plurality of individual means for securing the electrical contact means in the other contact-housing module.

8. A contact housing according to claim 6, wherein the contact-housing modules being able to be fixed to each other by means of the contact-lock means on a contact-housing module and a correspondingly formed fastening means on/in the other contact-housing module, the contact-lock means further being formed as a fastening means which preferably has a latch projection, and a latch recess.

9. A contact housing according to claim 8, wherein the contact-housing modules further having locking means which correspond to each other, and preferably the locking means of the one contact-housing module having a locking recess and the locking means of the other contact-housing module being a locking projection, the locking means in a closed position (G) of the contact housing being engaged with each other.

10. A contact housing according to claim 9, wherein the locking means being formed or provided such that, for the closed position (G) of the contact housing, a mutual movement of the contact-housing modules can be prevented by means of the locking means in cooperation with the contact-lock means and the corresponding fastening means.

* * * * *